US005495262A

United States Patent [19]

Klebe

[11] Patent Number: 5,495,262

[45] Date of Patent: Feb. 27, 1996

[54] MOLDED PLASTIC MICROWAVE ANTENNA

[75] Inventor: Douglas O. Klebe, Los Angeles, Calif.

[73] Assignee: Hughes Aircraft Company, Los Angeles, Calif.

[21] Appl. No.: 353,731

[22] Filed: Dec. 9, 1994

Related U.S. Application Data

[63] Continuation of Ser. No. 879,497, May 7, 1992, abandoned.

[51] Int. Cl.[6] ..... H01Q 21/00

[52] U.S. Cl. ..... 343/853; 343/776; 343/774; 427/304; 29/600

[58] Field of Search ..... 343/853, 776, 343/771, 774; 333/239, 248, 24.1, 157, 158; 427/304; 29/600, 601; H01Q 21/00

[56] References Cited

U.S. PATENT DOCUMENTS

| | | | |
|---|---|---|---|
| 3,195,079 | 7/1965 | Burton et al. | 333/239 |
| 3,576,579 | 4/1971 | Appelbaum et al. | 333/239 |
| 4,020,875 | 5/1977 | Akiba | 333/239 |
| 4,499,157 | 2/1985 | Mulliner et al. | 428/624 |

FOREIGN PATENT DOCUMENTS

| | | | |
|---|---|---|---|
| 751385 | 6/1956 | United Kingdom | 333/239 |
| 758457 | 10/1956 | United Kingdom | 333/239 |
| WO8909501 | 10/1989 | WIPO | H01Q 21/06 |

OTHER PUBLICATIONS

Johnson et al, "Radar Antennas", Antenna Engineering Handbook, 1984, pp. 32–20–32–23.

*Primary Examiner*—Donald T. Hajec

*Assistant Examiner*—Hoanganh Le

*Attorney, Agent, or Firm*—Leonard A. Alkov; W. K. Denson-Low

[57] ABSTRACT

A microwave radar antenna that substantially comprises molded or extruded thermoplastic components that are assembled into completed assemblies, are then metallized by either electroless copper or are electroplated with copper to achieve RF conductivity. The finished subassemblies are joined together forming the completed antenna. The molded, metallized, plastic antenna uses a thermoplastic material, such as polyetherimide, or suitable high strength, high temperature thermoplastic that is used to injection mold or extrude detailed microwave components. The molded components are assembled, using epoxy adhesives, solvents or other mechanical method into microwave subassemblies. These subassemblies are then either electroless copper plated or electroplated to provide RF conductivity. The metallized subassemblies are then joined together using mechanical methods to form a completed radar antenna, replacing heavier more costly metal radar antennas. Specifically, the molded, metallized, plastic antenna is comprised of an antenna aperture and electromechanical phase shifter section, centerfeeds comprising a horizontal feed network, interconnecting waveguides, a vertical feed network including conventional rotary field phase shifters, and a sum and difference monopulse feed network. The antenna also includes a suitable beam steering controller that provides electronic antenna beam steering and power supplies. The use of the present microwave antenna incorporating molded, metallized, plastic components results in an antenna having better performance, lighter weight, and much lower manufacturing costs than conventional metal antennas.

13 Claims, 6 Drawing Sheets

MOLDED PLASTIC MICROWAVE ANTENNA

This is a continuation application Ser. No. 07/879,497, filed May 7, 1992, now abandoned.

CROSS REFERENCE TO RELATED APPLICATIONS

Reference is made to copending U.S. patent application Ser. No. 07/880,123, filed on May 7, 1992, entitled "Molded Waveguide Components" and U.S. patent application Ser. No. 07/880,122, filed on May 7, 1992 entitled "Molded Metallized Plastic Microwave Components and Process for Manufacture".

BACKGROUND

The present invention relates generally to microwave antennas, and more particularly, to microwave antennas that are made of molded plastic material.

Conventional microwave ,antennas are generally made of metal components, and typically include an antenna aperture and electromechanical phase shifter, a horizontal feed network, a plurality of interconnecting waveguides, a vertical feed network including conventional rotary field phase shifters, and a sum and difference monopulse feed network. In general, all of these components have heretofore been fabricated out of metal. This results in a costly and heavy antenna system.

Reference is hereby made to two copending patent application, the first filed on 07/880,123, having Ser. No. May 7, 1992, and entitled "Molded Waveguide Components" and the second filed on 07/880,122, having Ser. No. May 7, 1992 and entitled "Molded Metallized Plastic Microwave Components and Process for Manufacture", the contents of which are incorporated herein by reference. These two patent applications address methods for manufacturing certain components employed in the present invention the fabrication of detailed components used to complete a molded metallized thermoplastic antenna in accordance with the present invention. Furthermore, U.S. Pat. No. 4,499,157, entitled "Solderable Plated Plastic Components and Processes for Manufacture and Soldering" assigned to the assignee of the present invention addresses fabrication of certain antenna components by soldering plated plastic components.

It is therefore an objective of the present invention to provide for a microwave antenna wherein substantially all antenna components are fabricated from molded or extruded, plated, plastic components.

SUMMARY OF THE INVENTION

In order to achieve the above objective, the present invention comprises a microwave radar antenna that substantially comprises molded or extruded thermoplastic components that are assembled into completed assemblies, are then metallized by either electroless or electroplated with copper to achieve RF conductivity. The finished subassemblies are joined together forming a completed microwave radar antenna.

The molded metallized plastic antenna uses a thermoplastic material, such as polyetherimide, Ultem 2300 or 2310, or any suitable high strength, high temperature thermoplastic that is used to injection mold or extrude detailed microwave components. The molded components are assembled, using epoxy adhesives, solvents or any suitable mechanical methods into microwave subassemblies. These subassemblies are then either electroless copper plated or electroplated to provide RF conductivity. The metallized subassemblies are then joined together using mechanical methods to form a completed radar antenna, replacing heavier more costly metal radar antenna components.

The molded metallized plastic antenna is comprised of an antenna aperture and electromechanical phase shifter section, a centerfeed section comprising a horizontal feed network, interconnecting waveguides, a vertical feed network including conventional rotary field phase shifters, and a sum and difference monopulse feed network. The antenna also includes a conventional beam steering controller that provides electronic antenna beam steering and a power supply.

The advantages of molded metallized plastic antenna are many, and include lower cost, lower weight, better performance, lower manufacturing costs, and superior RF performance. More particularly, injection molded or extruded thermoplastic details are finished into subassemblies replace individually machined, usually aluminum or magnesium, metal assemblies. The thermoplastic assembly cost is much less because of lower raw material cost and a dramatically shortened fabrication time. The metal details have each feature machined one at a time, where the thermoplastic details have them all simultaneously reproduced during the injection molding or extruding operation. Thermoplastics, which are suitable for this application, are typically 30 to 50% lighter for a given volume than aluminum. This allows the finished microwave radar antenna to be lighter, reducing the total radar set weight. Bonding before plating reduces the performance penalty of a possible high loss assembly joint. The lower manufacturing costs reduce in-process scrap costs. The plastic antenna of the present invention has superior RF performance when compared to similarly manufactured aluminum assemblies.

The use of the present microwave antenna incorporating molded metallized plastic components results in an antenna having better performance, fighter weight, and much lower manufacturing costs. This fabrication concept may be applied to new and existing commercial and military antenna applications having either the disclosed design or a fiat planar design.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
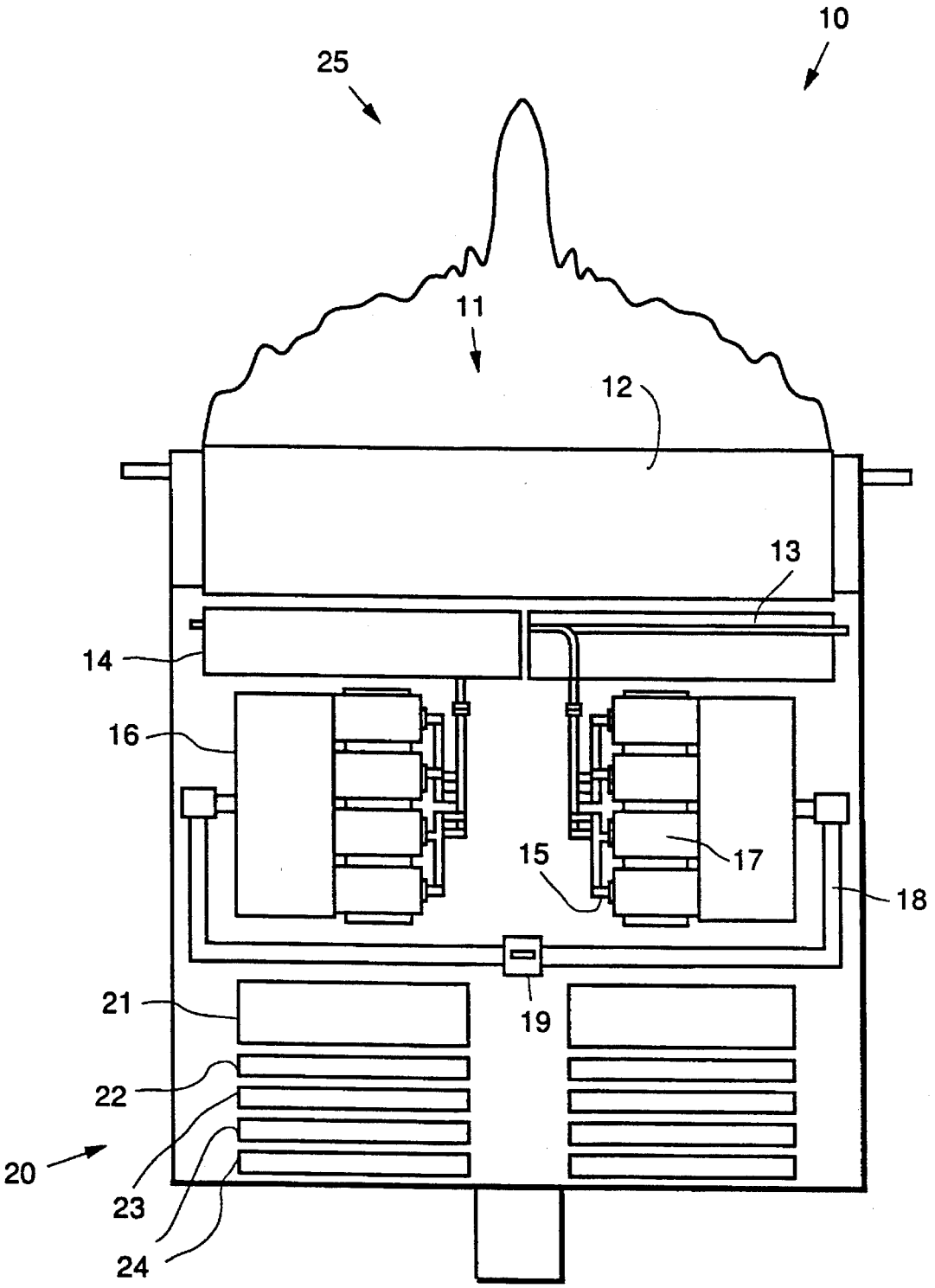
FIG. 1 shows a schematic diagram of a molded plastic microwave antenna in accordance with the principles of the present invention.

Referring to the drawing figures, FIG. 1 shows a schematic diagram of a molded, metallized, plastic microwave antenna 10 in accordance with the principles of the present invention. The molded, metallized, plastic antenna 10 is comprised of an antenna aperture 11 and electromechanical azimuth phase shifter section 12. A centerfeed section 13 comprising a horizontal feed network 14 is connected to the electromechanical azimuth phase shifter section 12. A plurality of interconnecting waveguides 15 (also referred to as waveguide assemblies 15) are connected between the centerfeed section 13 and a plurality of conventional rotary field phase shifters 17. A plurality of vertical feed networks 16 are coupled between the plurality of conventional rotary field phase shifters 17 and a sum and difference monopulse feed network 18. A magic tee 19 provides an input for the antenna 10 that is coupled to the sum and difference network 18. Electronics for the antenna 10 is provided and includes a conventional beam steering controller 20 that provides electronic antenna beam steering, power supplies 21 and voltage regulator 22, a plurality of digital electronics modules 23 and a plurality of drive electronics modules 24. An antenna beam 25 is shown emanating from the antenna aperture 11 depicting a typical output beam profile provided by the antenna 10.

Each of the components of the molded, metallized, plastic microwave antenna 10 of the present invention are comparable to conventional components that are made solely of machined or fabricated metal. In the present antenna 10, additional support structure for strengthening the molded plastic components are employed to provide for a rigid and stable antenna structure.

Figure 2:
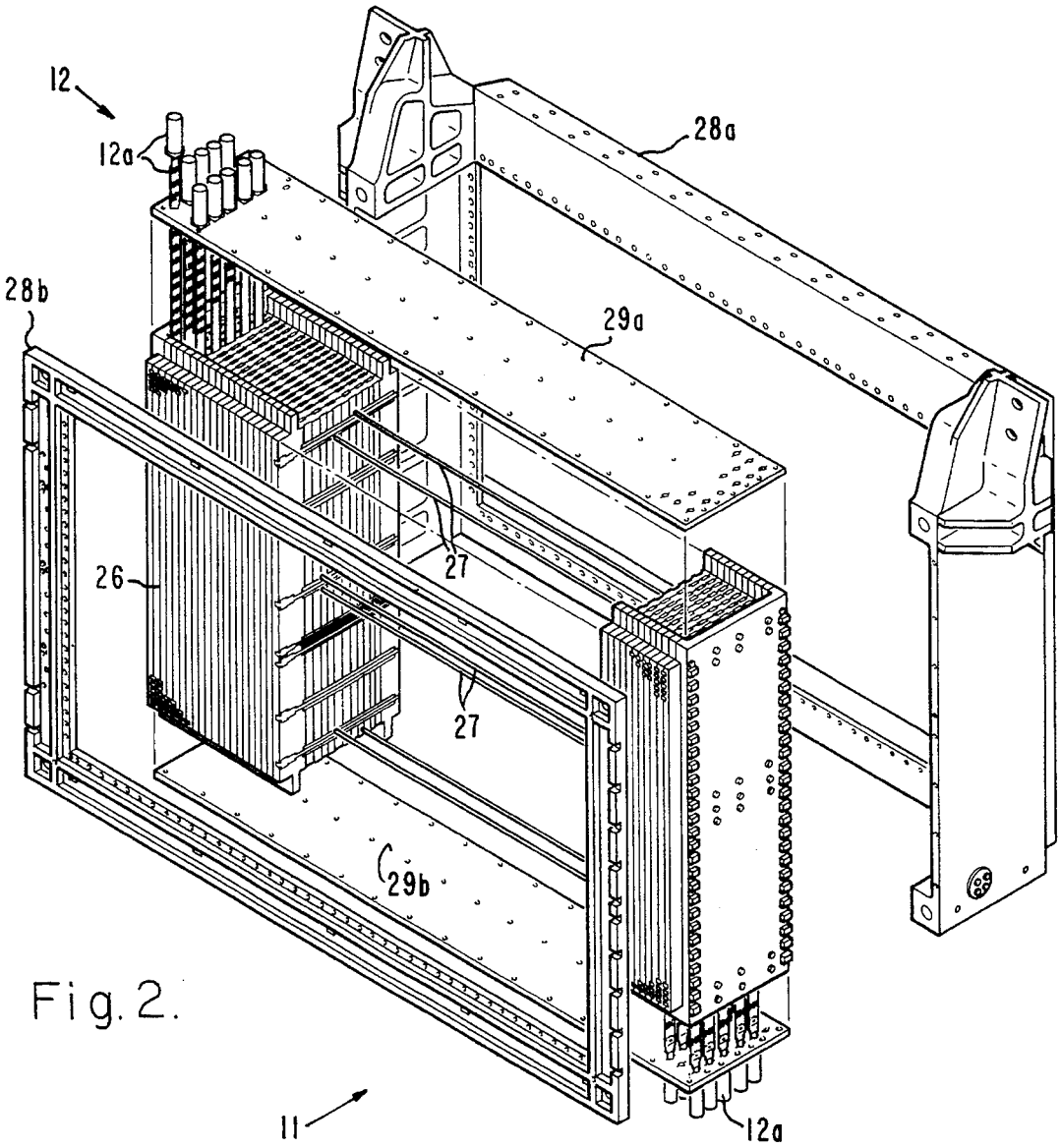
FIG. 2 shows details of the aperture section of the antenna of FIG. 1.

The antenna 10 is constructed from various subassemblies identified above that are fabricated separately using various methods that will be described below. FIG. 2 shows the aperture 11 and azimuth phase shifter section 12 of the antenna 10. The phase shifter section 12 is constructed from eighty-five (85) phase shifter plates 26 that are injection molded from polyetherimide thennoplastic (Ultem 2300 or 2310, for example) and metallized using either an electroless or an electroplate copper plating process. Each of the phase shifter plates 26 comprise one-half of a completed waveguide, and by stacking and aligning the eighty-five (85) plates together, the antenna 10 is formed having eighty-four (84) similar waveguides. These phase shifter plates 26 are substantially the same as conventional metal phase shifter plates in terms of their design and operation. However, in the present invention, they are made of molded plastic that is formed and then plated to provide their RF transmitting properties.

More particularly, the finished phase shifter plates 26 are stacked, aligned, and clamped together using tensioning rods 27 made from a high strength material such as beryllium copper, for example. A housing or enclosure comprising a centerfeed frame **28*a* and an aperture frame 28*b* that forms a front cover, both of which are made of aluminum, for example, along with the tensioning rods 27, and top and bottom actuator plates 29*a*, 29*b*, are employed to secure the eighty-five (85) phase shifter plates 26 together into a solid structure. A plurality of conventional azimuth phase shifters 12*a* are shown extending through the phase shifter plates 26. These components and operations complete the phase shifter section 12 of the plastic radar antenna 10**.

Figure 3:
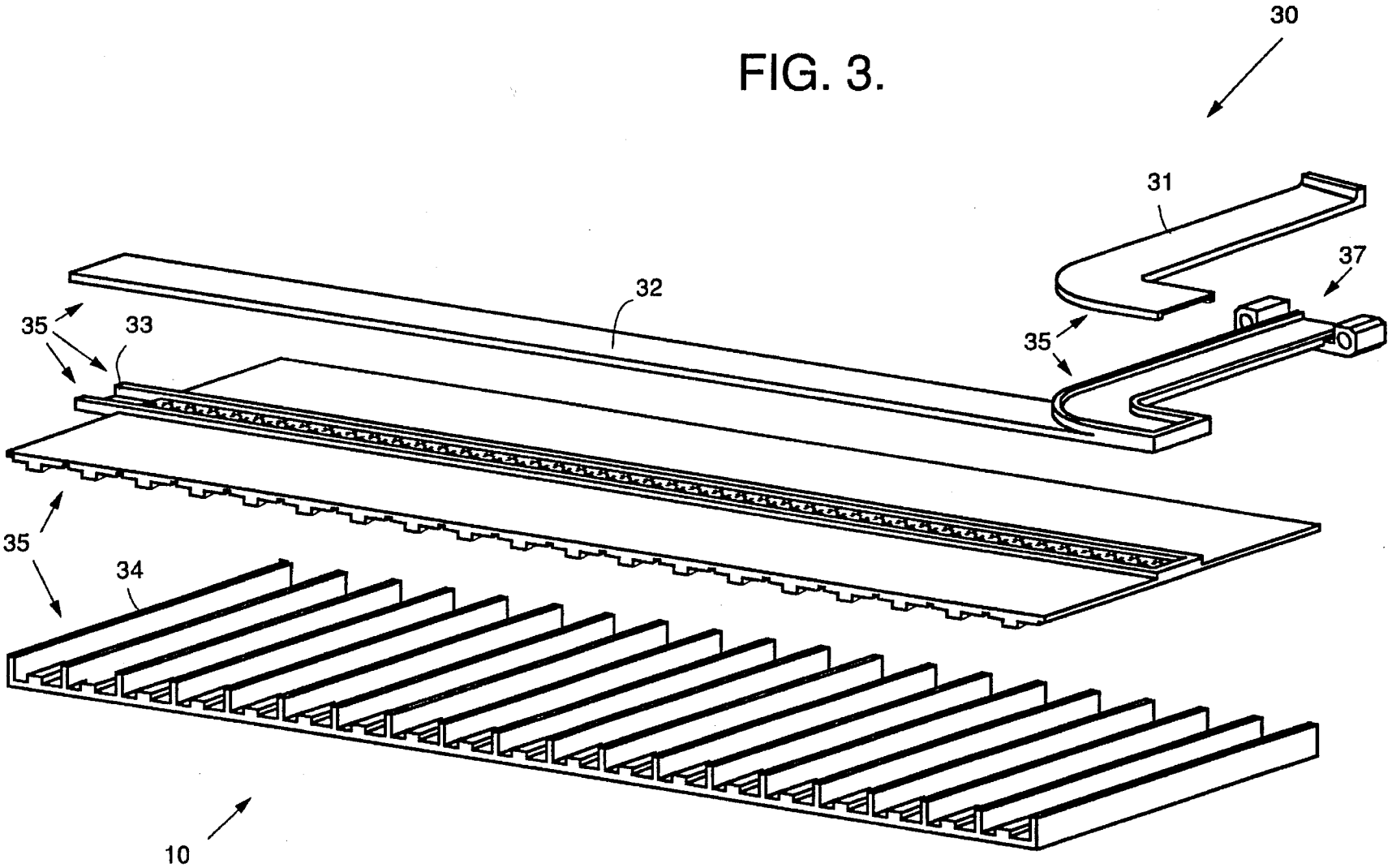
FIG. 3 shows a molded centerfeed waveguide assembly employed in the antenna of FIG. 1.

One centerfeed waveguide assembly 30 that forms part of the centerfeed section 13 is shown in detail in FIG. 3. The centerfeed waveguide assembly 30 is assembled by bonding a plurality of molded thermoplastic details together, which details include an input cover 31, a folded slot/transverse waveguide cover 32, an upper transition 33, and a lower transition 34. The input cover 31, folded slot/transverse waveguide cover 32, upper transition 33, and lower transition 34 are also hereinafter referred to as centerfeed assembly components 30. The centerfeed waveguide assembly 30 is assembled using the molded details by bonding, and finished dimensions of the bonded unit are such that the assembly 30 is thereafter electroless copper plated, resulting in final overall desired dimensions.

The bonding operation uses epoxy adhesive 35 to join the input cover 31, folded slot/transverse waveguide cover 32, upper transition 33 and lower transition 34 together. The bond lines between each of the centerfeed assembly components 30 and the location of the epoxy adhesive 35 (represented by arrows 35 in FIG. 3). The centerfeed assembly components 30 are typically designed so that the molded details selflocate, aiding in the assembly operation. A bonding fixture (not shown) is used to apply clamping pressure to the centerfeed assembly components 30, while the epoxy adhesive 35 is cured at about 300° F. for about 45 minutes. After bonding, the bonding fixture is disassembled and the centerfeed waveguide assembly 30 has its critical flange surfaces 37 finish machined. Once critical flange surfaces 37 have been properly machined to meet requirements, the fully assembled centerfeed waveguide assembly 30 is ready for electroless copper plating. This plating process is typically an electroless copper plating process adapted for Ultem 2300 or 2310 thermoplastic.

The electroless copper plating process helps to make the present invention unique. The electroless copper plating is applied to the finished microwave waveguide assembly 30 subsequent to fabrication. This process allows complex components, like the centerfeed waveguide assembly 30, to be plated after assembly. This removes the problems associated with using a secondary conductive method (as in conventional soldering processes) to make the final assembly and align the critical flange surfaces 37.

Figure 4:
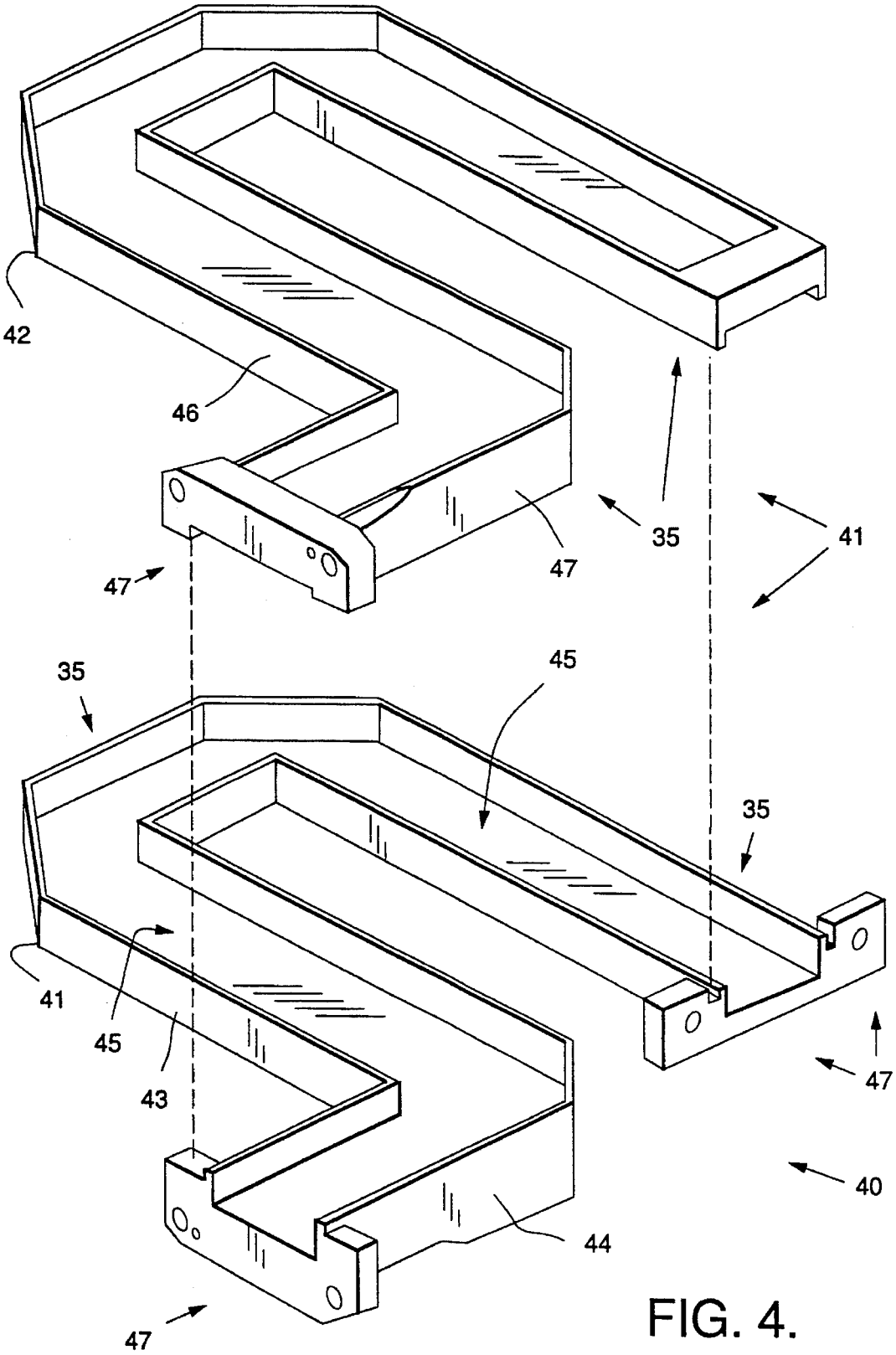
FIG. 4 shows a molded interconnecting waveguide assembly employed in the antenna of FIG. 1.

With reference to FIG. 4, a perspective view of an interconnecting waveguide 15 (or interconnecting waveguide assembly 15) is shown in detail, and it comprises an assembly similar to the centerfeed waveguide assembly 30, but is much simpler in design and construction. There are four configurations of the interconnecting waveguide assembly 15 and each configuration is molded in two halves and assembled. FIG. 4 shows two such halves of one such configuration, comprising a base 41 and a cover 42. The base 41 and cover 42 are also hereinafter referred to as interconnecting waveguide assembly components 40. The base 41 is shown as a U-shaped member having a sidewall 43 and a plurality of edgewalls 44 contacting the sidewall 43 to form a U-shaped cavity 45. The cover 42 is also shown as a U-shaped member that is adapted to mate with the base 41, and has a sidewall 46 and a plurality of edgewalls 47 contacting the sidewall 46.

The interconnecting waveguide assembly 15 is assembled by bonding the two molded halves comprising the base 41 and the cover 42 together. The bonding operation uses the one component epoxy adhesive 35 to join the base 41 and cover 42 together. These components are also designed such that the parts serf locate to aid in the assembly operation. The bonding fixture is used to apply clamping pressure to the base 41 and cover 42 while the adhesive 35 disposed on the appropriate edges of the waveguide components 40 is cured at about 300° F. for about 45 minutes. After bonding, the bonding fixture is disassembled and the interconnecting waveguide assembly 15 has its critical flange surfaces 47 finish machined. When the critical surfaces 47 meet requirements the interconnecting waveguide assembly 15 is then ready for electroless copper plating as was described above with reference to the centerfeed waveguide assembly 30.

Injection mold tooling has been fabricated to mold the thermoplastic components that make up the centerfeed and interconnecting waveguide assemblies 30, 15. The various components have been assembled and tested to the same requirements as current metal production pans, and better performance has been demonstrated. Molded centerfeed and interconnecting waveguide assemblies 30, 15 have been subjected to extensive environmental and vibration testing and finished centerfeed and interconnecting waveguide assemblies 30, 15 have passed all tests without failure.

The molded waveguide fabrication process used in making the molded waveguide components of the present invention comprises the following steps. The centerfeed assembly components 30 and interconnecting waveguide assembly components 40 are injection molded, using a high strength, high temperature thermoplastic, such as Ultem 2300 or 2310 thermoplastic, available from General Electric Company, Plastics Division. Secondary machining of the centerfeed assembly components 30 of the centerfeed waveguide assembly 30 is preformed. The centerfeed assembly components 30 are then assembled using the epoxy adhesive 35, such as Hysol Dexter Corporation type EA 9459, for example, and then the assembly is cured at 300° F. for about 45 minutes. Then, the critical flange surfaces 37 are finish machined. Each bonded centerfeed waveguide assembly 30 is then electroless copper plated (0.0002 to 0.0003 inches thick) and the flange surfaces 37 are burnished. Terminating loads (not shown) and a load cover (not shown) disposed on the rear edge of the centerfeed waveguide assembly 30, as viewed in FIG. 3, are installed. The copper plated centerfeed assembly 30 is then coated with polyimide, for example, and then it is vacuum cured at about 250° F. for about 60 minutes. An electrical acceptance test is then performed to ensure proper electrical performance of the centerfeed waveguide assembly 30.

The electroless copper plating process for injection molded glass reinforced Ultem surfaces is performed as follows. The plating process is controlled by using a conventional Ultem electroless copper plating solution make-up and control, and conventional Ultem electroless copper plating, available from Shipley Company, Incorporated (hereinafter "Shipley"). The centerfeed and interconnecting waveguide assemblies 30, 15 are cleaned and degreased using Oakite 166, available from Oakite Products, Inc. at 150° F. The centerfeed and interconnecting waveguide assemblies 30, 15 are conditioned using XP-9010 at 125° F., available from Shipley. The centerfeed and interconnecting waveguide assemblies 30, 15 are dipped in sodium permanganate CDE-1000, available from Enthone, at 170° F. Alternatively, chromic acid or potassium permanganate, for example, may be employed in this step. The centerfeed and interconnecting waveguide assemblies 30, 15 are dipped in a neutralizer CDE-1000 at 130° F. The centerfeed and interconnecting waveguide assemblies 30, 15 are etched at ambient temperature. The etched centerfeed and interconnecting waveguide assemblies 30, 15 are dipped in a solution of Camprep 404, available from Shipley at 100° F. The centerfeed and interconnecting waveguide assemblies 30, 15 are then dipped in a solution of Cataposit 44, available from Shipley at 100° F. The etched centerfeed and interconnecting waveguide assemblies 30, 15 are dipped in a solution comprising Accelerator 19 available from Shipley at ambient temperature. A copper flashing is applied to the centerfeed and interconnecting waveguide assemblies 30, 15 using Copper Strike 328 ABC, for example, available from Shipley, at ambient temperature. A heavy copper deposition using XP-8835, manufactured by Shipley, at 160° F. is then applied to the centerfeed and interconnecting waveguide assemblies 30, 15. Finally, the plated centerfeed and interconnecting waveguide assemblies 30, 15 are air dried.

The interconnecting waveguide assemblies 15 attach to conventional rotary field ferrite phase shifters 17. These phase shifters 17 provide elevation scan phase shift and connect to the vertical feed network 16. The interconnection is achieved in a conventional manner using machine screws, and the like, and will not be described in detail herein.

Figure 5:
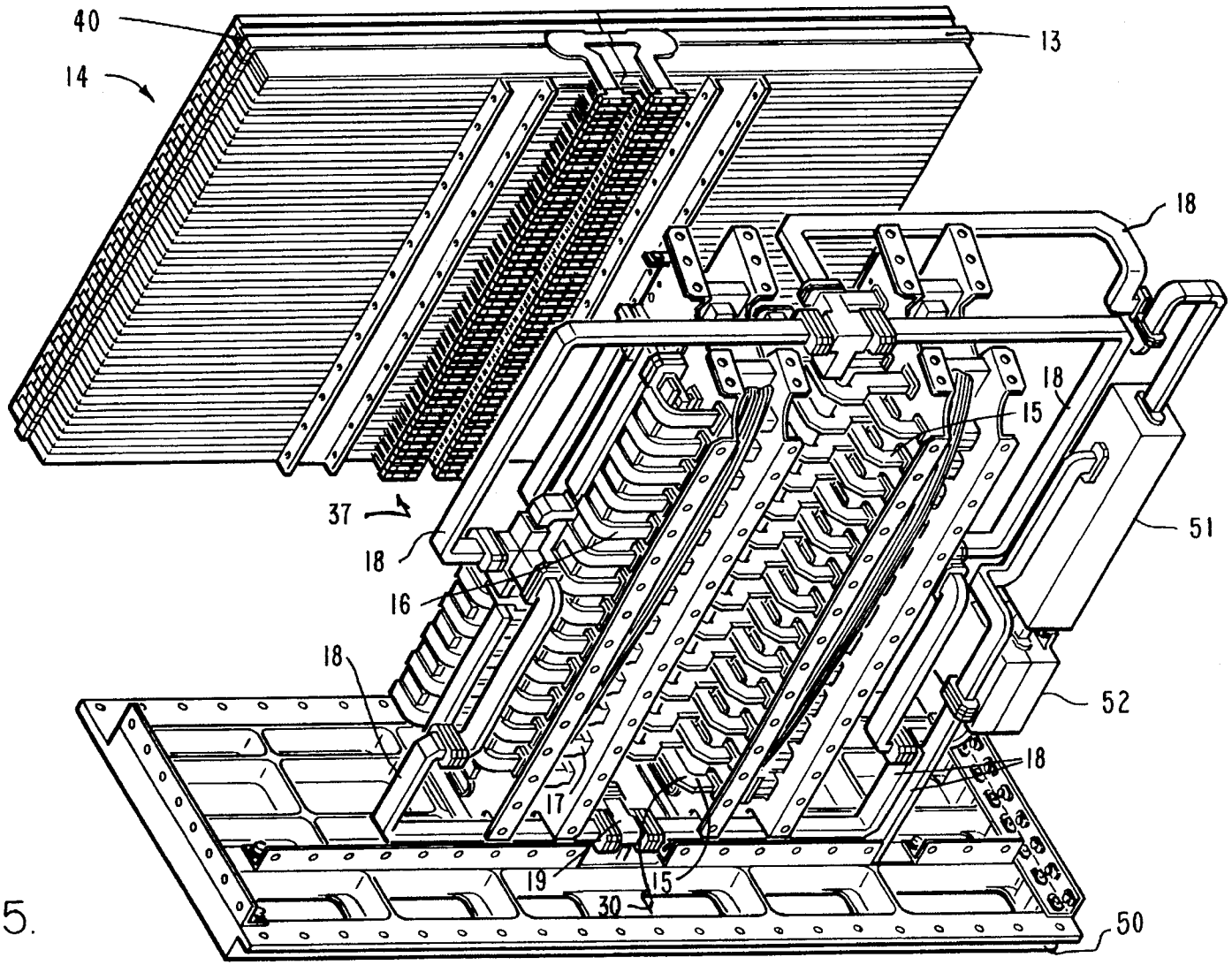
FIG. 5 shows a exploded perspective view of a fully assembled interconnecting waveguide assembly and centerfeed waveguide assembly employed in the antenna of FIG. 1.

FIG. 5 shows a exploded perspective view of a fully assembled interconnecting waveguide section 15 and centerfeed waveguide section 13 employed in the antenna 10 of FIG. 1. The interconnecting waveguide section 15 is secured to a base plate 50 for rigidity. As is shown in FIG. 5, the interconnecting waveguide section 15 is comprised of one hundred and four (104) interconnecting waveguide assemblies 30 that are coupled between the plurality of phase shifters 17 and each of the respective centerfeed waveguide assemblies 40 of the centerfeed waveguide section 13. The centerfeed waveguide section 13 is also comprised of one hundred and four (104) centerfeed waveguide assemblies 40 stacked to form the horizontal feed network 14. The flange surfaces 37 of the interconnecting waveguide assemblies 30 mate with and are secured to the flange surfaces 37 of the centerfeed waveguide assemblies 30. A resolver 51 and a guard/difference switch 52 are coupled into the antenna 10 by way of a portion of the sum and difference network 18 in a convention manner. The guard/difference switch 52 switches between guard and difference channels of the antenna 10 in a conventionally known manner.

Figure 6:
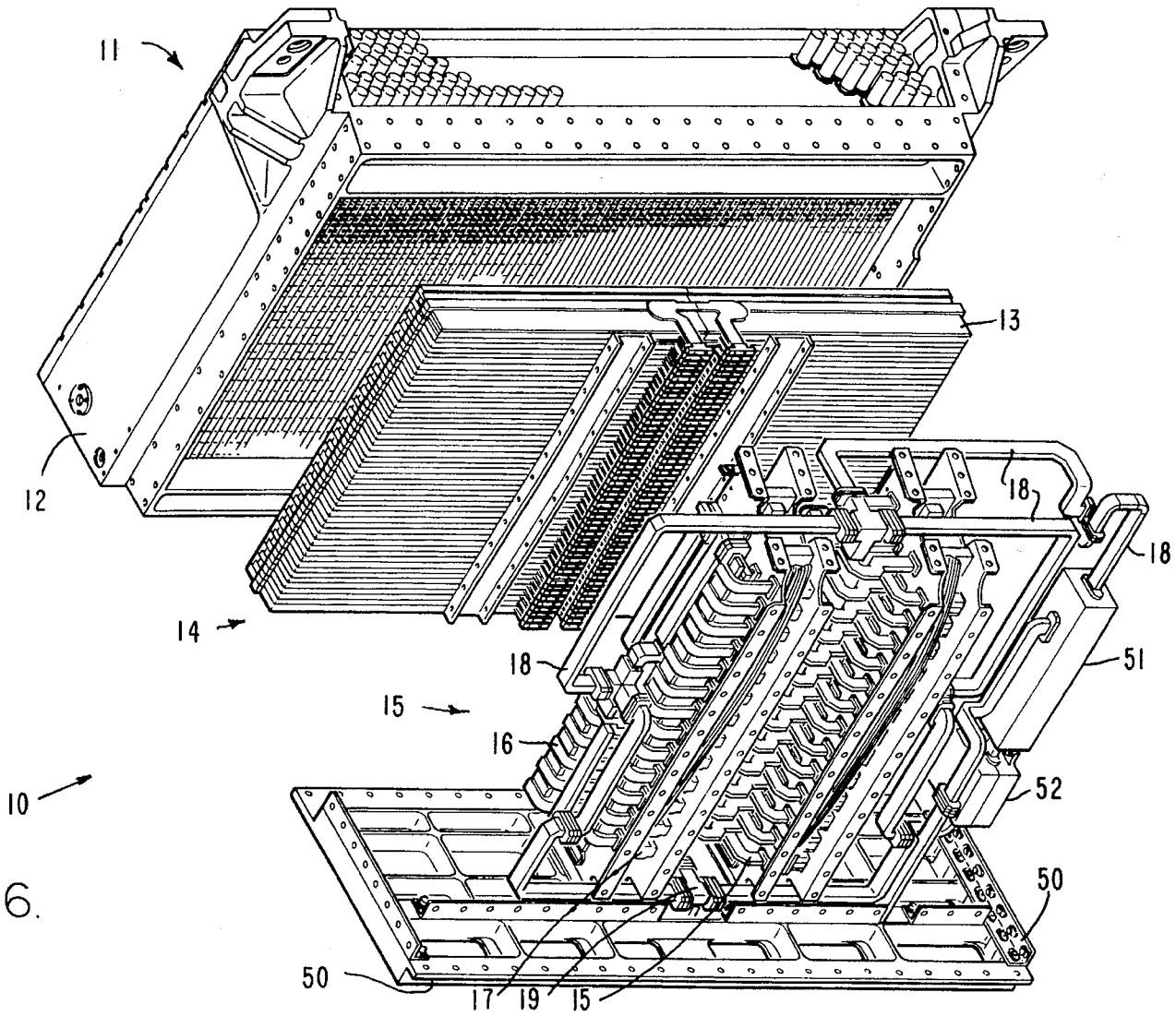
FIG. 6 shows an exploded perspective view of a completely assembled microwave antenna corresponding to the antenna of FIG. 1.

FIG. 6 shows an exploded perspective view of a completely assembled plastic microwave antenna 10 corresponding to the antenna 10 shown schematically in FIG. 1. FIG. 6 shows the aperture 11 and electromechanical phase shifter section 12, the centerfeed waveguide section 13, and the interconnecting waveguide section 15 illustrating their relative locations and mating surfaces and structures. Energy is applied to the input magic tee 19 and propagates through the sum and difference network 18 to the vertical feed networks 16. Thereafter the applied energy is phase shifted by the phase shifters 17 and coupled by way of the interconnecting waveguide section 15 through the centerfeed waveguide section 13 to the phase shifter section 12 and out the aperture 11.

Thus there has been described a new and improved microwave antenna that is substantially made of molded plastic material. It is to be understood that the above-described embodiment is merely illustrative of some of the many specific embodiments which represent applications of the principles of the present invention. Clearly, numerous and other arrangements can be readily devised by those skilled in the art without departing from the scope of the invention.

What is claimed is:

1. An antenna comprising:

an azimuth phase shifter assembly comprising a plurality of metallized molded plastic waveguides and an antenna aperture;

a centerfeed waveguide assembly comprising a horizontal feed network that is coupled to the azimuth phase shifter assembly and that comprises a plurality of metallized molded plastic centerfeed waveguide assemblies;

a plurality of metallized molded plastic interconnecting waveguides respectively coupled to individual ones of the plurality of centerfeed waveguide assemblies of the centerfeed waveguide assembly;

a plurality of rotary field phase shifters coupled to individual ones of the plurality of interconnecting waveguides;

a plurality of metallized molded plastic vertical feed networks coupled to selected ones of the plurality of rotary field phase shifters; and a sum and difference monopulse feed network having an input port that is coupled to the plurality of vertical feed networks.

2. The antenna of claim 1 wherein the centerfeed waveguide assembly comprises a plurality of molded plastic centerfeed waveguide assemblies whose components are fabricated from molded plastic and subsequently metallized.

3. The antenna of claim 2 wherein the plurality of molded plastic centerfeed waveguide assemblies are mated and stacked together to form the horizontal feed network.

4. The antenna of claim 2 wherein the plurality of vertical feed networks are fabricated from molded plastic and subsequently metallized.

5. The antenna of claim 2 wherein the sum and difference monopulse feed network is fabricated from molded plastic and subsequently metallized.

6. The antenna of claim 5 wherein the sum and difference monopulse feed network is fabricated from molded plastic and subsequently metallized.

7. The antenna of claim 1 wherein the plurality of vertical feed networks are fabricated from molded plastic and subsequently metallized.

8. The antenna of claim 7 wherein the sum and difference monopulse feed network is fabricated from molded plastic and subsequently metallized.

9. The antenna of claim 1 wherein the sum and difference monopulse feed network is fabricated from molded plastic and subsequently metallized.

10. The antenna of claim 1 further comprising:

a beam steering controller coupled to the input port that provides for electronic antenna beam steering; and power supply means including voltage regulation means coupled to the beam steering controller for providing power thereto.

11. The antenna of claim 1 wherein the azimuth phase shifter assembly comprises an electromechanical azimuth phase shifter assembly.

12. A microwave antenna comprising:

an azimuth phase shifter assembly fabricated from a plurality of molded plastic waveguide portions that are molded and subsequently metallized, and wherein the plurality of molded plastic waveguide portions are mated and stacked together to form a plurality of waveguides, the azimuth phase shifter assembly forming an antenna aperture;

a centerfeed waveguide assembly that forms a horizontal feed network that is coupled to the azimuth phase shifter assembly and which comprises a plurality of molded plastic centered waveguide assemblies whose components are fabricated from molded plastic, assembled, and thereafter metallized, and wherein the plurality of molded plastic centerfeed waveguide assemblies are mated and stacked together to form the horizontal feed network;

a plurality of interconnecting waveguides fabricated from molded plastic, assembled, and thereafter metallized respectively coupled to individual ones of the plurality of centerfeed waveguide assemblies of the centerfeed waveguide assembly;

a plurality of rotary field phase shifters coupled to individual ones of the plurality of interconnecting waveguides;

a plurality of vertical feed networks coupled to selected ones of the plurality of rotary field phase shifters that are fabricated from molded plastic and subsequently metallized; and a sum and difference monopulse feed network having an input port that is fabricated from molded plastic and subsequently metallized coupled to the plurality of vertical feed networks.

13. The antenna of claim 12 further comprising:

a beam steering controller coupled to the input port that provides for electronic antenna beam steering; and power supply means including voltage regulation means coupled to the beam steering controller for providing power thereto.

* * * * *